US006253581B1

(12) United States Patent
Rhode et al.

(10) Patent No.: US 6,253,581 B1
(45) Date of Patent: Jul. 3, 2001

(54) RADAR DISPERSION FABRICS

(75) Inventors: Werner Rhode, Greenville; Hay F. Sparks, Jr., Spartanburg, both of SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/449,955

(22) Filed: Nov. 29, 1999

(51) Int. Cl.[7] ..... D04B 21/00
(52) U.S. Cl. ..... 66/170; 66/195; 66/202
(58) Field of Search ..... 66/169 R, 170, 66/195, 202, 192; 442/304, 312; 342/1, 2, 3, 4

(56) References Cited

U.S. PATENT DOCUMENTS 3,986,828 * 10/1976 Hoffman, Jr. et al. ..... 8/115.68
4,015,451 * 4/1977 Gajjar ..... 66/195
4,064,305 * 12/1977 Wallin ..... 442/308
4,388,364 * 6/1983 Sanders ..... 442/313
4,688,403 * 8/1987 Gajjar ..... 66/195
4,802,346 * 2/1989 Gajjar ..... 66/195
4,815,299 * 3/1989 Bryant ..... 66/202
4,926,910 * 5/1990 Wade ..... 139/425 R
5,029,457 * 7/1991 Gajjar ..... 66/195
5,732,573 * 3/1998 Sexton ..... 66/195

* cited by examiner

*Primary Examiner*—Danny Worrell
(74) *Attorney, Agent, or Firm*—Terry T. Moyer; Jeffery E. Bacon

(57) ABSTRACT

A three-bar polyester tricot warp knit fabric for use in a radar dispersion fabric having patterns stitched on the three bars as indicated:

Bar I 2-3/4-3/1-0/3-4/2-3/5-4/2-3/5-6/8-9/6-5/3-2/5-4
Bar II 7-6/4-3/1-0/3-4/7-6/4-5/7-6/5-6/8-9/6-5/7-6/4-5
Bar III 4-5/6-7/8-9/7-6/5-4/4-5/5-4/3-2/1-0/2-3/4-5/5-4

16 Claims, 2 Drawing Sheets

RADAR DISPERSION FABRICS

This invention relates to a warp knit fabric which can be manufactured readily at low cost and be used as a radar dispersion and/or absorption fabric after heat setting and finishing of the heat-set fabric with an appropriate finish.

It is an object of the invention to provide a tricot warp knit fabric which can be taken off the knitting machine, heat set and then finished to provide a darkened radar dispersion fabric.

Other objects and advantages of the invention will become readily apparent as the specification proceeds to describe the invention on which the enclosed drawing shows the 3-bar stitch pattern in which.

Looking now to the drawings there is shown a point diagram indicating the stitch pattern of a 3-bar tricot warp knitting machine. It is within the scope of the invention to use a Raschel warp knitting machine but it is preferred that the fabric be made on a tricot warp knit machine.

Figure 1:
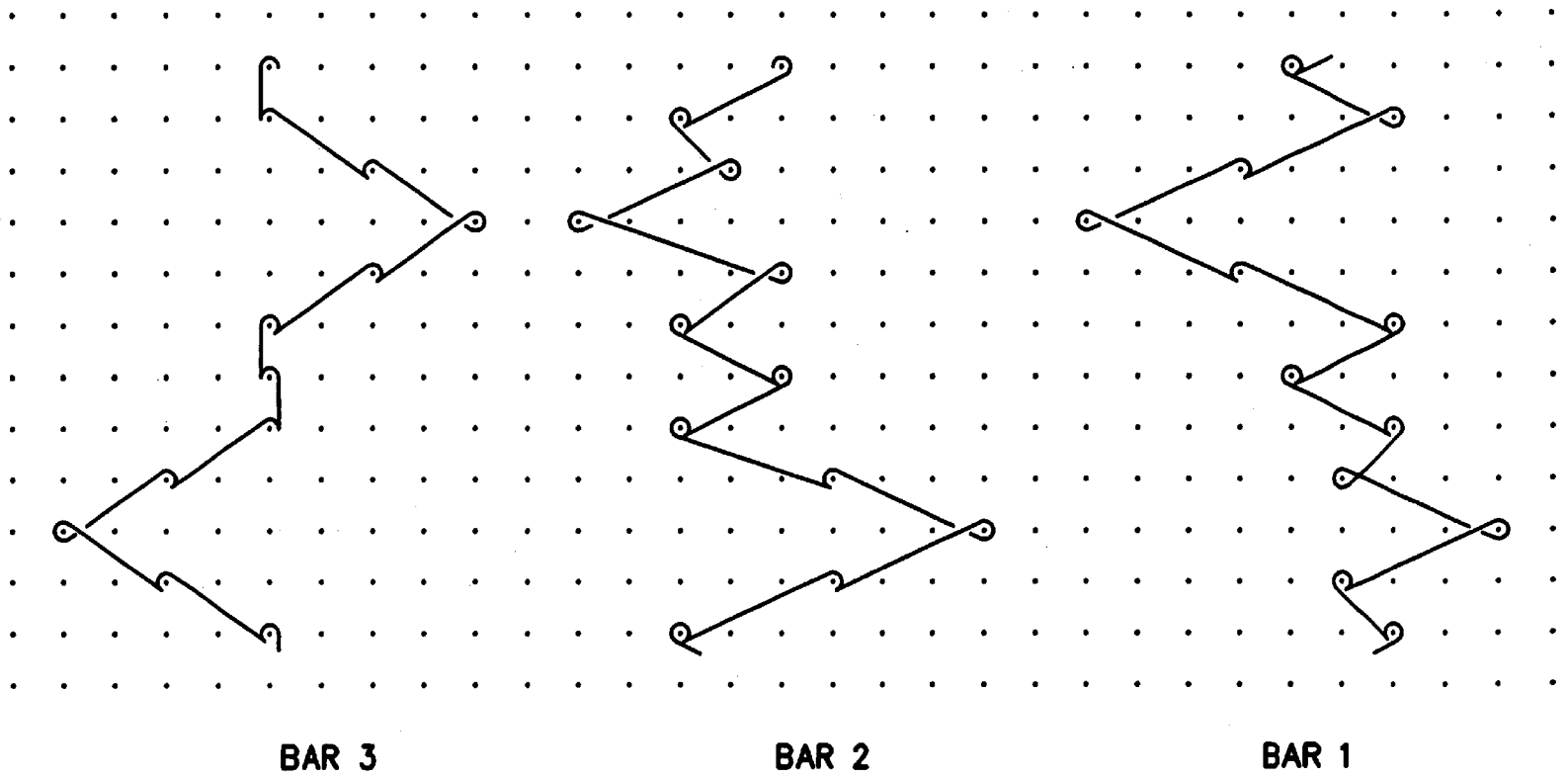
FIG. 1 is the 3-bar stitch pattern.
Figure 2:
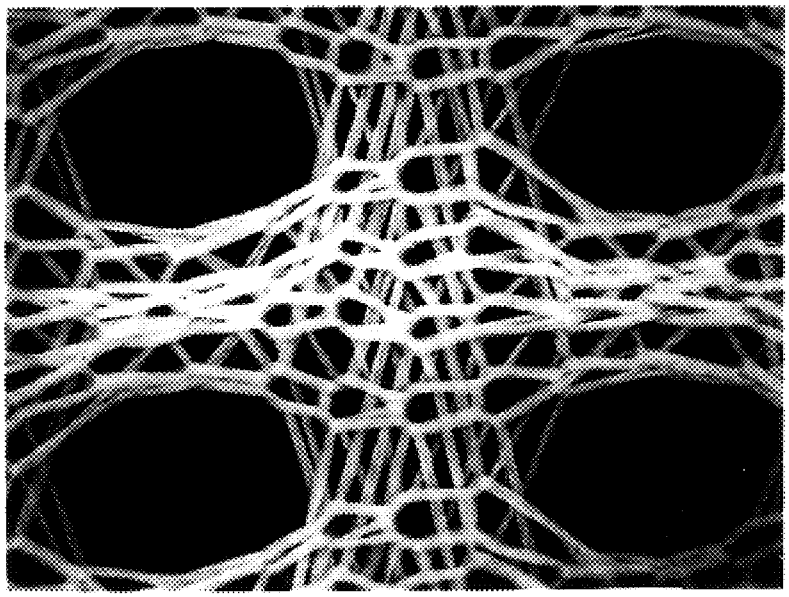
FIG. 2 is a top photomicrograph of the fabric after it has been heat set.
Figure 3:
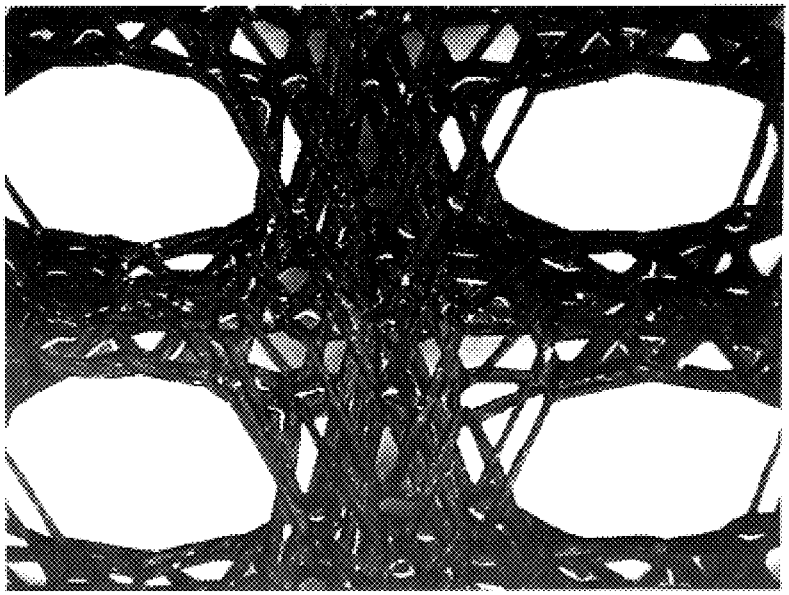
FIG. 3 is a photomicrograph of the fabric of FIG. 2 treated to disperse radar waves.

In the preferred form of the invention, the 3-bar knit tricot fabric shown in FIGS. 1–3 is 100% polyester and is heat set after it comes off the knitting machine. As shown in FIG. 1 the stitch pattern for the 70 denier polyester yarn on Bar 1 is 2-3/4-3/1-0/3-4/2-3/5-4/2-3/5-6/8-9/6-5/3-2/5-4 and then repeats. The stitch pattern for the 70 denier yarn on Bar 2 is 7-6/4-3/1-0/3-4/7-6/4-5/7-6/5-6/8-9/6-5/7-6/4-5 and then repeats. For strength, Bar 3 knits a 40 denier polyester with a stitch pattern of 4-5/6-7/8-9/7-6/5-4/4-5/5-4/3-2/1-0/2-3/4-5/5-4 and then repeats. This fabric is knit on a 71" machine and after heat setting has a minimum width of 67" with flat selvedges without any curl.

Preferably the warp knit fabric has 28 wales/inch and 29 courses per inch with a weight of 1.9–2.2 ounces/yarn with a ball burst of 85 lbs. minimum which exceeds the required average of 75 lbs. minimum. This fabric when blackened or darkened as shown in FIG. 3 provides excellent radar dispersion properties as well as some of the radar absorption properties.

The unique stitching patterns allow this fabric, after finishing with a recipe which tends to stiffen and immobilize the structure, to retain mobility between yarns such that yarn bunching occurs to share loads applied to the fabric.

The herein described tricot warp knit fabric is inexpensive to manufacture, easily handled and has the physical characteristics, when finished to have a darkened or blackened surface to provide excellent radar dispersion and/or absorption properties. It also provides a fabric which has higher tear values and ball burst than similar structures.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. 3-bar heat set polyester warp knit fabric for use as a substrate for radar dispersion fabrics comprising: a warp knit fabric having a stitch pattern made on the front bar of 2-3/4-3/1-0/3-4/2-3/5-4/2-3/5-6/8-9/6-5/3-2/5-4; a stitch pattern made on the second bar of 7-6/4-3/1-0/3-4/7-6/4-5/7-6/5-6/8-9/6-5/7-6/4-5; and a stitch pattern made on the third bar of 4-5/6-7/8-9/7-6/5-4/4-5/5-4/3-2/1-0/2-3/4-5/5-4.

2. The fabric of claim 1 wherein the yarn knit is 70 denier on bars 1 and 2 and 40 denier on bar 3.

3. The fabric of claim 1 wherein the warp knit is a tricot knit.

4. The fabric of claim 3 wherein the yarn knit is 70 denier on bars 1 and 2 and 40 denier on bar 3.

5. The fabric of claim 4 wherein said fabric has 29 courses per inch.

6. The fabric of claim 5 wherein said fabric has a weight of 1.9–2.2 ounces per yard.

7. A substrate for a radar dispersion fabric comprising: a heat set 3-bar polyester tricot fabric having a minimum of 28 courses per inch and 28 wales per inch, said fabric having a weight of 1.9–2.2 ounces per yard and a ball burst of at least 75 lbs.

8. The fabric of claim 7 wherein said fabric has a ball burst of 85 lbs.

9. The fabric of claim 7 wherein said fabric has 29 courses per inch.

10. A radar dispersion fabric comprising: a darkened, polyester tricot warp knit fabric made on three bars having a minimum of 28 courses per inch, a weight of 1.9–2.2 ounces per yard and a ball burst of at least 75 lbs.

11. The fabric of claim 10 wherein said fabric has 29 courses per inch.

12. The fabric of claim 10 wherein the fabric has a first bar stitch pattern of 2-3/4-3/1-0/3-4/23/5-4/2-3/5-6/8-9/6-5/3-2/5-4; a second stitch bar pattern of 7-6/4-3/1-0/3-4/7-6/4-5/7-6/5-6/89/6-5/7-6/4-5; and a third bar stitch pattern of 4-5/6-7/8-9/7-6/5-4/4-5/5-4/3-2/1-0/2-3/4-5/5-4.

13. The fabric of claim 12 wherein said first and second bar patterns are 70 denier yarn and the third bar yarn is 40 denier.

14. The fabric of claim 13 wherein said fabric has a weight of 1.9–2.2 ounces per yard.

15. The fabric of claim 14 wherein said fabric has a ball burst of at least 75 lbs.

16. The fabric of claim 1 wherein said fabric has a ball burst of 85 lbs.

* * * * *